US011692538B2

(12) United States Patent
Kinoshita et al.

(10) Patent No.: US 11,692,538 B2
(45) Date of Patent: Jul. 4, 2023

(54) COMPRESSOR SYSTEM AND METHOD OF INSERTING AND PULLING OUT BUNDLE OF COMPRESSOR

(71) Applicant: MITSUBISHI HEAVY INDUSTRIES COMPRESSOR CORPORATION, Tokyo (JP)

(72) Inventors: Takuya Kinoshita, Hiroshima (JP); Hideki Yamada, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 147 days.

(21) Appl. No.: 17/345,637

(22) Filed: Jun. 11, 2021

(65) Prior Publication Data

US 2022/0056899 A1 Feb. 24, 2022

(30) Foreign Application Priority Data

Aug. 20, 2020 (JP) ..... 2020-139053

(51) Int. Cl.
*F04B 39/14* (2006.01)
*F04B 39/12* (2006.01)
(Continued)

(52) U.S. Cl.
CPC ..... *F04B 39/14* (2013.01); *F04B 39/121* (2013.01); *F04C 11/00* (2013.01); *F04C 11/001* (2013.01);
(Continued)

(58) Field of Classification Search
CPC ..... F04C 23/001; F04C 23/00; F04C 11/00; F04C 23/008; F04C 23/02; F04C 11/001;
(Continued)

(56) References Cited

U.S. PATENT DOCUMENTS 5,295,808 A * 3/1994 Machida ..... F04C 18/023 417/410.5
8,757,918 B2 * 6/2014 Ramnarain ..... F04B 17/03 403/DIG. 4
(Continued)

FOREIGN PATENT DOCUMENTS

JP 2012-177337 A 9/2012

*Primary Examiner* — Peter J Bertheaud
(74) *Attorney, Agent, or Firm* — Osha Bergman Watanabe & Burton LLP

(57) ABSTRACT

A compressor system includes: a first compressor including a first casing having a cylindrical shape, and a first bundle capable of being inserted into and pulled out from the first casing in an axial direction of the first casing; and a second compressor including a second casing having a cylindrical shape, and a second bundle capable of being inserted into and pulled out from the second casing in an axial direction of the second casing. The first and second compressors are arranged to face each other to cause pullout directions of the respective bundles to be opposite to each other. A maintenance space shareable for insertion and pullout operations of the first bundle and insertion and pullout operations of the second bundle is interposed between the first bundle and the second bundle, and is available for the bundle under the insertion and pullout operations.

9 Claims, 3 Drawing Sheets

(51) Int. Cl.

| | |
|---|---|
| ***F04C 23/00*** | (2006.01) |
| ***F04C 11/00*** | (2006.01) |
| ***F04C 23/02*** | (2006.01) |
| ***F04D 17/12*** | (2006.01) |
| ***F04D 29/62*** | (2006.01) |
| ***F04B 41/06*** | (2006.01) |

(52) U.S. Cl.
CPC ..... *F04C 11/008* (2013.01); *F04C 23/00* (2013.01); *F04C 23/001* (2013.01); *F04C 23/008* (2013.01); *F04C 23/02* (2013.01); *F04D 17/122* (2013.01); *F04D 29/624* (2013.01); *F04B 41/06* (2013.01)

(58) Field of Classification Search
CPC .... F04C 11/008; F04D 29/624; F04D 17/122; F04B 39/14; F04B 39/121; F04B 41/06
See application file for complete search history.

(56) References Cited

U.S. PATENT DOCUMENTS

| | | | | |
|---|---|---|---|---|
| 9,080,645 | B2 * | 7/2015 | Hood | F04B 35/04 |
| 9,488,192 | B2 * | 11/2016 | Ota | F04D 29/644 |
| 10,001,143 | B2 * | 6/2018 | Yoshida | F04D 29/284 |
| 10,233,945 | B2 * | 3/2019 | Yoshida | F04D 29/403 |
| 10,280,922 | B2 * | 5/2019 | Doepker | F04C 23/008 |
| 2013/0266440 | A1 | 10/2013 | Ota et al. | |

* cited by examiner

COMPRESSOR SYSTEM AND METHOD OF INSERTING AND PULLING OUT BUNDLE OF COMPRESSOR

BACKGROUND OF THE INVENTION

Field of the Invention

The present disclosure relates to a compressor system including a plurality of compressors, and to a method of inserting and pulling out a bundle of a compressor into/from a casing.

Description of the Related Art

A so-called vertically divided compressor includes a columnar bundle in which components such as impellers, diaphragms, bearings, and seals are integrally assembled, and a cylindrical casing housing the bundle (see JP 2012-177337 A). The compressor is coupled with a driving source such as a motor and a steam turbine, and is typically installed at an appropriate place while being supported by a base member referred to as a base board or a base plate or the like.

To maintain such a compressor, the whole of the bundle is pulled out from the casing in an axial direction of the casing. The bundle taken out from the casing is hung up by a crane or the like, and is placed on a truck or the like. The maintained bundle or a replacement bundle is inserted into the casing.

It is desirable to stably support the bundle and to smoothly move the bundle in the axial direction during a period when the bundle is inserted into or pulled out from the casing. To do so, for example, as disclosed in JP 2012-177337 A, an assembling and disassembling device that includes a plurality of rollers detachably attached to the bundle, and a driving mechanism capable of pushing and pulling out the bundle into/from the casing is used. The rollers attached to the bundle move on rails laid on a bundle pullout side of the casing along the axial direction of the casing.

A compressor system adopted in various kinds of facilities such as a plant and a power plant typically includes a plurality of compressors. A driving source such as a motor is coupled with a shaft of each of the plurality of compressors. A set of the compressor and the driving source coupled with each other is referred to as a train.

For example, a control console is installed adjacent to the train including the compressor and the driving source. Further, a space necessary for insertion and pullout of the compressor bundle, a truck placement space, a passage for a person, and other spaces are secured for each of the plurality of compressors. An enclosure to block sunlight is provided over a plurality of trains in some cases.

It is desirable to reduce an apparatus cost and a maintenance cost of the compressor system including incidental facilities of the train.

The present disclosure is directed to cost reduction of the compressor system.

SUMMARY OF THE INVENTION

A compressor system according to the present disclosure includes: a first compressor including a first casing having a cylindrical shape, and a first bundle that is capable of being inserted into and pulled out from the first casing in an axial direction of the first casing; and a second compressor including a second casing having a cylindrical shape, and a second bundle that is capable of being inserted into and pulled out from the second casing in an axial direction of the second casing. The first compressor and the second compressor are arranged to face each other to cause pullout directions of the respective bundles to be opposite to each other. A maintenance space shareable for insertion and pullout operations of the first bundle and insertion and pullout operations of the second bundle is interposed between the first bundle and the second bundle, and is available for the first bundle or the second bundle to occupy under the insertion and pullout operations.

In the present disclosure, the arrangement in which the first compressor and the second compressor face each other means the following state.

The state is a state where a range where the first bundle is projected in the axial direction of the first casing toward the second bundle and a range where the second bundle is projected in the axial direction of the second casing toward the first bundle are at least partially overlapped with each other.

A method of inserting and pulling out a bundle of a compressor according to the present disclosure includes, in a state where a maintenance space shareable for insertion and pullout operations of a bundle of a first compressor having a cylindrical casing and insertion and pullout operations of a bundle of a second compressor having a cylindrical casing is interposed between the bundles and the first compressor and the second compressor are arranged to face each other to cause pullout directions of the respective bundles to be opposite to each other, pulling out the bundle of the first compressor or the bundle of the second compressor from the corresponding casing to the maintenance space or inserting the bundle of the first compressor or the bundle of the second compressor into the corresponding casing, while allowing the bundle of the first compressor or the bundle of the second compressor to occupy the maintenance space.

Based on the arrangement in which the first compressor and the second compressor face each other according to the present disclosure, when the maintenance space that is interposed between the first bundle and the second bundle and is shared for insertion and pullout of both bundles has a length of one bundle, pullout of the first bundle and pullout of the second bundle can be performed without causing interference between the bundles in the same maintenance space unless the pullout of the first bundle and the pullout of the second bundle are simultaneously performed. The same is true of insertion of the first bundle and insertion of the second bundle.

Thus, according to the present disclosure, it is possible to arrange the first compressor and the second compressor close to each other while securing the necessary maintenance space between the first bundle and the second bundle during the maintenance. This makes it possible to reduce the space necessary for installation of the compressor system as compared with a case where an individual maintenance space is required for each of the first bundle and the second bundle. Saving of the installation space leads to saving of the space for the whole of the compressor system including the incidental facilities necessary for operation of the compressor system, such as control consoles of the compressor and the driving source, and the protective enclosure. This makes it possible to reduce a cost of facilities including the incidental facilities.

DETAILED DESCRIPTION OF THE PREFERRED EMBODIMENT

A preferred embodiment is described below with reference to accompanying drawings.

[Configuration Outline of Compressor System]

Figure 1:
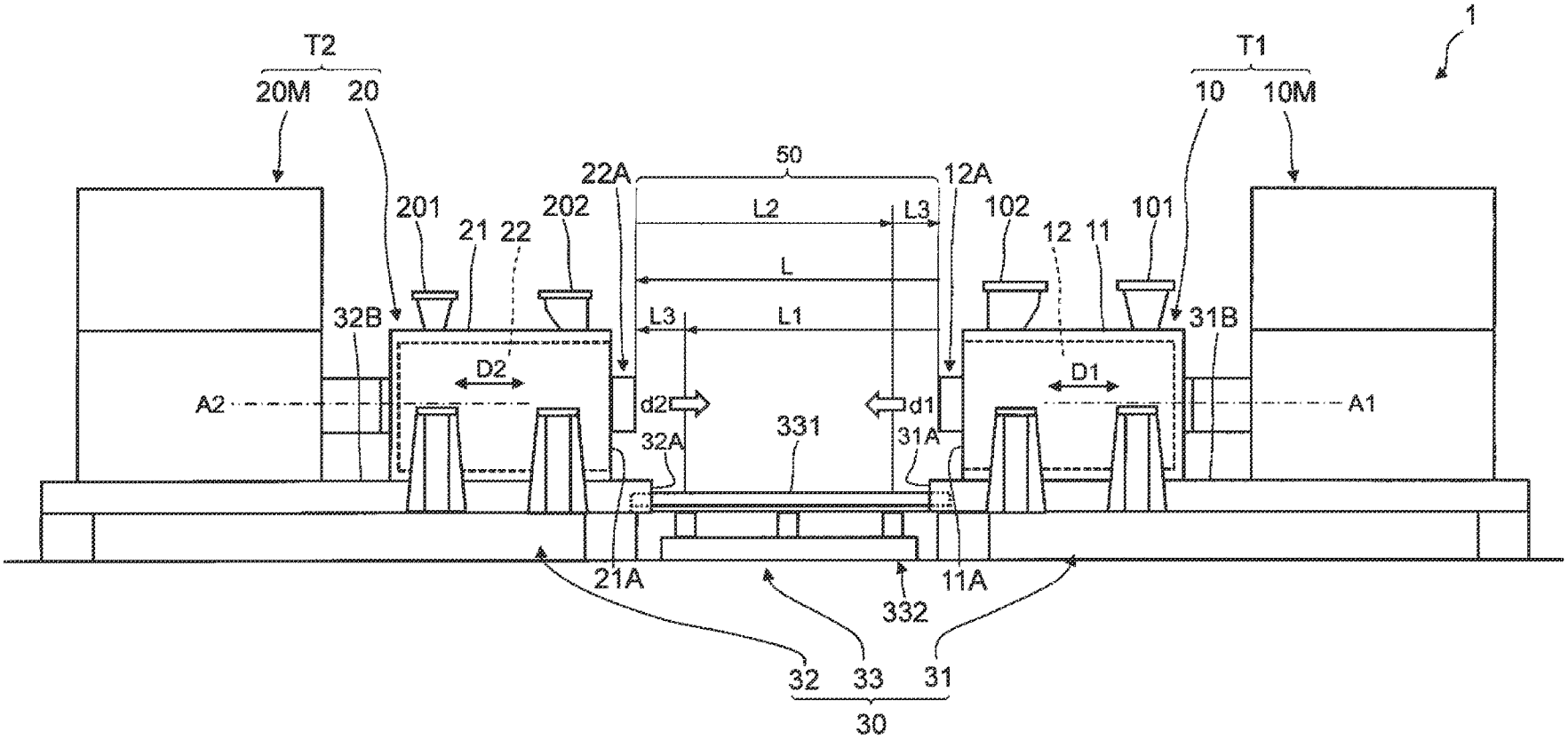
FIG. 1 is a side view illustrating a compressor system according to an embodiment of the present disclosure.
Figure 2:
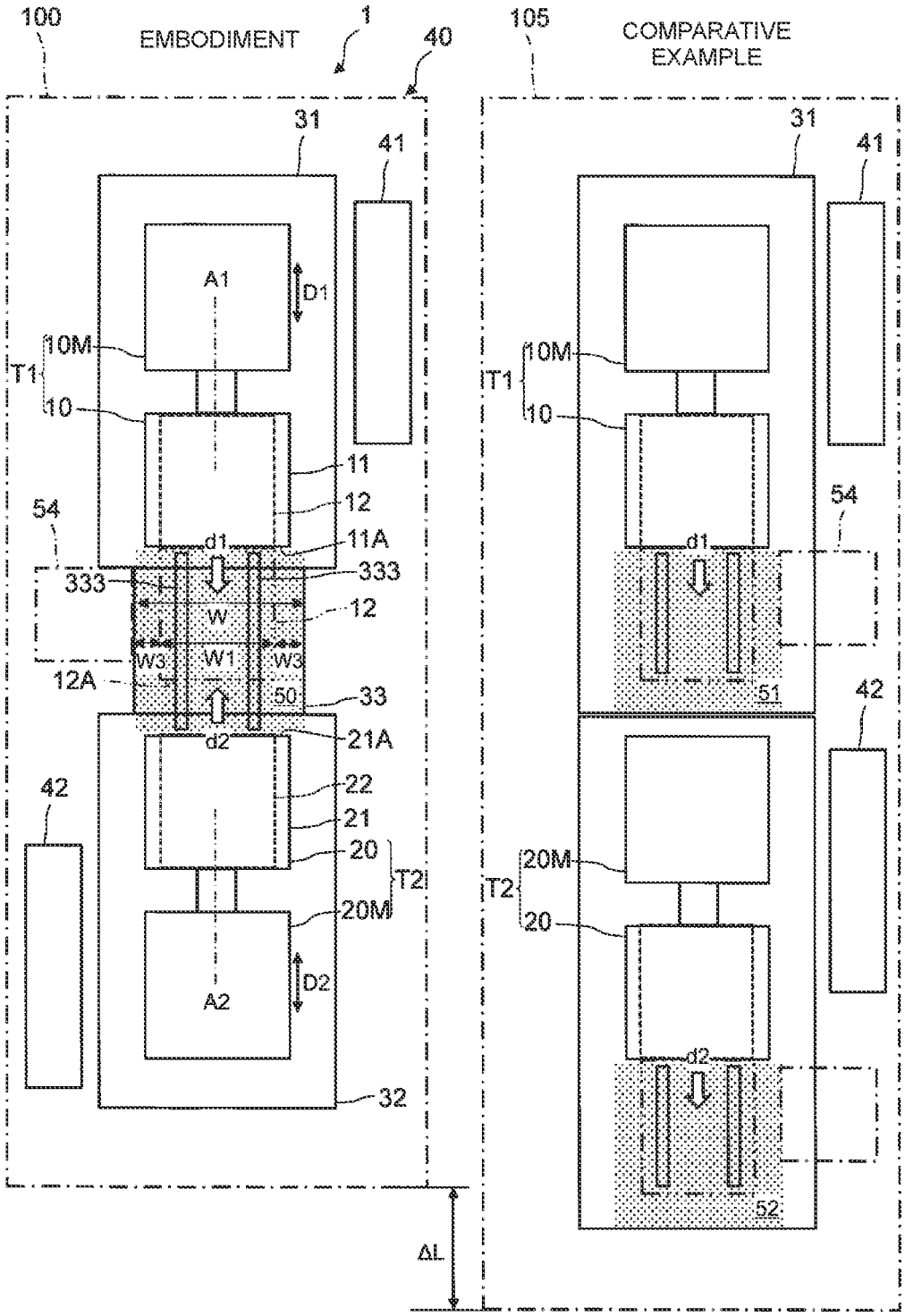
FIG. 2 is a plan view illustrating the compressor system according to the embodiment and a compressor system according to a comparative example.

A compressor system 1 illustrated in FIG. 1 and FIG. 2 includes a first train T1, a second train T2, a base member 30, and incidental facilities 40 that include apparatuses arranged around the first train T1 and the second train T2. The base member 30 supports the first train T1 and the second train T2 as a whole, and is installed at an appropriate place.

The first train T1 includes a first compressor 10 and a first motor 10M serving as a driving source coupled with a shaft of the first compressor 10.

The second train T2 includes a second compressor 20 and a second motor 20M serving as a driving source coupled with a shaft of the second compressor 20.

As the driving source of the first compressor 10 or the second compressor 20, a steam turbine, a gas turbine, or other turbines may be adopted.

For example, the incidental facilities 40 correspond to control consoles 41 and 42 respectively corresponding to the first train T1 and the second train T2, and an unillustrated protective enclosure (such as sunshade) to block sunlight over the whole of the compressor system 1. In addition, the incidental facilities 40 may include a lubricating oil cooling apparatus associated with each of the first train T1 and the second train T2.

A place where the compressor system 1 is installed is required to have a space where the whole of the compressor system 1 including the incidental facilities 40 in addition to the compressors and the motors is installable. An installation space 100 necessary to install the whole of the compressor system 1 has a size substantially similar to a plane size of the protective enclosure and corresponds to a region illustrated by an alternate long and short dash line in FIG. 2.

[Base Member]

The base member 30 can be composed of a plurality of portions divided on an appropriate basis in consideration of a transportable weight, size, etc. The base member 30 according to the present embodiment includes a first base portion 31 supporting the first train T1, a second base portion 32 supporting the second train T2, and a maintenance base portion 33 connecting the first base portion 31 and the second base portion 32.

The first base portion 31, the second base portion 32, and the maintenance base portion 33 may be integrally formed as long as the integrated base portion has a transportable weight and size.

The first compressor 10 and the first motor 10M are installed on the first base portion 31. The second compressor 20 and the second motor 20M are installed on the second base portion 32.

An axis A1 set in the first compressor 10 and the first motor 10M and an axis A2 set in the second compressor 20 and the second motor 20M both extend in a horizontal direction.

The maintenance base portion 33 includes a plate 331 that is horizontally laid between an end part 31A of the first base portion 31 and an end part 32A of the second base portion 32, and a seat 332 supporting the plate 331.

As illustrated in FIG. 2, a width of the plate 331 is narrower than a width of the first base portion 31 and a width of the second base portion 32; however, the width of the plate 331 is not limited thereto.

A supporting surface 31B of the first base portion 31 and a supporting surface 32B of the second base portion 32 are not necessarily positioned on the same plane. The maintenance base portion 33 is disposed horizontally irrespective of heights of the supporting surfaces 31B and 32B.

[First Compressor and Second Compressor]

The first compressor 10 includes a first casing 11 having a cylindrical shape, and a first bundle 12 that has a substantially columnar shape and can be inserted into and pulled out from the first casing 11 in an axial direction D1 of the first casing 11. The axial direction D1 corresponds to a direction of the axis A1 of the first compressor 10 and the first motor 10M.

The "bundle" of the compressor corresponds to an assembly in which unillustrated components such as one or a plurality of impellors, diaphragms, bearings, and seal members are integrally assembled.

The first casing 11 includes a suction portion 101 from which fluid is supplied to the impellers inside the first bundle 12, and a discharge portion 102 from which the fluid compressed by rotation of the impellers is discharged.

As with the first compressor 10, the second compressor 20 also includes a second casing 21 having a cylindrical shape, and a second bundle 22 that has a substantially columnar shape and can be inserted into and pulled out from the second casing 21 in an axial direction D2 of the second casing 21. The axial direction D2 corresponds to a direction of the axis A2 of the second compressor 20 and the second motor 20M. In the present embodiment, the axial direction D1 and the axial direction D2 are coincident with each other.

The second casing 21 includes a fluid suction portion 201 and a fluid discharge portion 202.

Capacity of the first compressor 10 and capacity of the second compressor 20 may be the same as or different from each other. Dimensions of the first bundle 12 and the second bundle 22 in the axial direction and a radial direction are appropriately set based on the capacities of the respective compressors and the like. The dimensions of the first casing 11 and the second casing 21 are each appropriately set based on the dimension of the bundle to be housed.

As illustrated in FIG. 2, the first bundle 12 is pulled out from the first casing 11 in parallel with the axial direction D1 in a direction (d1) indicated by a void arrow. The first bundle 12 is pulled out in the direction d1 toward a side opposite to the first motor 10M. An end part of the first bundle 12 positioned at a front part of the first bundle 12 (front end side of void arrow) in the pullout direction d1 is referred to as a pullout-side end part 12A.

Likewise, the second bundle 22 is pulled out from the second casing 21 in parallel with the axial direction D2 in a direction (d2) indicated by a void arrow while a pullout-side end part 22A is directed forward.

The first bundle 12 of the first compressor 10 is inserted into and pulled out from the same end part 11A of the first casing 11 in the axial direction D1. Likewise, the second bundle 22 of the second compressor 20 is inserted into and pulled out from the same end part 21A of the second casing 21 in the axial direction D2.

The present embodiment improves arrangement of the plurality of compressors 10 and 20 in the compressor system 1.

As illustrated in FIG. 1 and FIG. 2, the first compressor 10 and the second compressor 20 are arranged in tandem such that the axis A2 is positioned on an extension of the axis A1.

Further, the first compressor 10 and the second compressor 20 are arranged to face each other while the pullout-side end part 12A of the first bundle 12 and the pullout-side end part 22A of the second bundle 22 face each other such that the pullout direction d1 of the first bundle 12 and the pullout direction d2 of the second bundle 22 are opposite to each other.

Further, a maintenance space 50 necessary for pullout of the bundles 12 and 22 respectively from the casings 11 and 21 and insertion of the bundles 12 and 22 respectively into the casings 11 and 21 is interposed between the pullout-side end part 12A of the first bundle 12 and the pullout-side end part 22A of the second bundle 22.

The first compressor 10 and the first motor 10M, and the second compressor 20 and the second motor 20M are arranged substantially symmetrically with respect to the maintenance space 50.

[Maintenance Space]

The maintenance space 50 corresponds to a substantially rectangular-parallelepiped space provided between the first bundle 12 and the second bundle 22. The maintenance space 50 can be shared for insertion and pullout operations of the first bundle 12 and insertion and pullout operations of the second bundle 22, and is available for the first bundle 12 or the second bundle 22 to occupy under the insertion and pullout operations. For example, to maintain the first compressor 10, the first bundle 12 can be pulled out from the first casing 11 so as to protrude to the maintenance space 50, or to maintain the second compressor 20, the second bundle 22 can be pulled out from the second casing 21 so as to protrude to the same maintenance space 50.

After the whole of the first bundle 12 is pulled out from the first casing 11, the first bundle 12 is hung up by, for example, an unillustrated crane, and is transferred to an unillustrated truck arranged near the maintenance space 50. The second bundle 22 pulled out from the second casing 21 is similarly hung up and transferred.

When the maintenance space 50 has a length of one bundle, pullout of the first bundle 12 and pullout of the second bundle 22 can be performed without causing interference between the bundles 12 and 22 in the same maintenance space 50 unless the pullout of the first bundle 12 and the pullout of the second bundle 22 are simultaneously performed.

At this time, when a length L1 of the first bundle 12 in the axial direction D1 and a length L2 of the second bundle 22 in the axial direction D2 are equal to each other, the "length of one bundle" corresponds to a length of any one of the first bundle 12 and the second bundle 22. When the length L1 and the length L2 are not equal to each other, the "length of one bundle" corresponds to a larger one of the length L1 and the length L2. FIG. 1 illustrates an example in which the length L1 and the length L2 are equal to each other.

A more specific method of determining the dimension of the maintenance space 50 is described below.

In a width direction of the base member 30 (in a direction intersecting with axial directions D1 and D2), the maintenance space 50 has a dimension corresponding to a width (diameter) of each of the first bundle 12 and the second bundle 22. In a case where the width of the first bundle 12 and the width of the second bundle 22 are not equal to each other, the width of the maintenance space 50 is set based on a larger one of the width of the first bundle 12 and the width of the second bundle 22.

The maintenance space 50 is also shared for insertion of the first bundle 12 into the inner side of the first casing 11 and insertion of the second bundle 22 into the inner side of the second casing 21. The minimum length of the maintenance space 50 in the axial direction necessary for insertion of each of the first bundle 12 and the second bundle 22 is equivalent to the minimum length of the maintenance space 50 in the axial direction necessary for pullout of each of the first bundle 12 and the second bundle 22.

If the maintenance space 50 has a length twice the length L1, a half region of the maintenance space 50 is used for pullout and insertion of the first bundle 12, and a remaining half region is used for pullout and insertion of the second bundle 22. Therefore, it is unnecessary to share the maintenance space 50 for insertion and pullout operations of the first bundle 12 and insertion and pullout operations of the second bundle 22. In this case, a plane size of the whole of the compressor system 1 including the incidental facilities 40 is increased by the length of the maintenance space 50. Increase in size increases cost of the base member 30, the protective enclosure, and the like.

When the maintenance space 50 is shared as in the present embodiment, it is possible to arrange the first train T1 and the second train T2 close to each other while securing necessary maintenance space 50 during maintenance, between the pullout-side end part 12A and the pullout-side end part 22A during a time other than the maintenance. This makes it possible to reduce the installation space of the whole of the compressor system 1 and to reduce the apparatus cost.

The maintenance space 50 is shared on the premise that the first compressor 10 and the second compressor 20 are arranged to face each other while the pullout-side end part 12A of the bundle 12 and the pullout-side end part 22A of the bundle 22 face each other.

If the first compressor 10 and the second compressor 20 are arranged in tandem but the pullout direction d1 of the first bundle 12 and the pullout direction d2 of the second bundle 22 are coincident with each other as illustrated in a comparative example in FIG. 2, it is necessary to provide a maintenance space 52 dedicated to the second bundle 22 in addition to a maintenance space 51 dedicated to the first bundle 12. In this case in the comparative example, an installation space 105 wider by, for example, ΔL than the installation space 100 of the embodiment is required, and the cost is increased due to upsizing of the base member 30 and the protective enclosure.

In other words, according to the compressor system 1 in the present embodiment, it is possible to achieve cost reduction by saving the entire installation space as compared with, for example, the comparative example illustrated in FIG. 2 based on improvement in which the first compressor 10 and the second compressor 20 are arranged to face each other such that the pullout direction d1 of the first bundle 12 and the pullout direction d2 of the second bundle 22 are opposite to each other.

The maintenance space 50 of the present embodiment is a space on the plate 331 of the maintenance base portion 33. A truck placement space 54 where an unillustrated truck for carrying the first bundle 12 or the second bundle 22 is placed is secured near the plate 331.

More specifically, the length and the width of the maintenance space 50 are determined in the following manner, for example.

(Length)

A dimension obtained by adding a length of a work region where a worker works in front of the bundle 12 or the bundle 22, to the length of one of the bundles 12 and 22.

The length L of the maintenance space 50 illustrated in FIG. 1 corresponds to a dimension obtained by adding a length L3 of the work region to the bundle length L1 (=L2).

(Width)

A dimension obtained by adding a width of a work region necessary for hanging up and transferring each bundle to the truck, to the width of one of the bundles 12 and 22.

A width W of the maintenance space 50 illustrated in FIG. 2 corresponds to a dimension obtained by adding a total sum (W3 and W3) of widths of respective work regions to a bundle width W1.

In the maintenance space 50, rails 333 supported on the plate 331 and extending in the axial directions D1 and D2 are laid. As in the example illustrated in FIG. 2, two rails 333 are laid in parallel. The rails 333 engage with rollers described below attached to the first bundle 12 or the second bundle 22 during the maintenance. The rails 333 continue from a vicinity of an end part of the first casing 11 on the second compressor 20 side to a vicinity of an end part of the second casing 21 on the first compressor 10 side.

Since the first bundle 12 and the second bundle 22 are pulled out along the rails 333, it is possible to pull out the bundles while maintaining straightness of the bundle 12 relative to the casing 11 and straightness of the bundle 22 relative to the casing 21 to avoid interference between the casing and the corresponding bundle.

The rails 333 laid in the maintenance space 50 can also be shared for pullout of the first bundle 12 and pullout of the second bundle 22. The rails 333 are laid in the maintenance space 50 not only during the maintenance but also constantly, which eliminates necessity of laying the rails 333 for the maintenance. This makes it possible to rapidly start any of the maintenance work of the first compressor 10 and the maintenance work of the second compressor 20.

The first compressor 10 and the second compressor 20 can be arranged such that the respective axes A1 and A2 are coincident with the same straight line in a planar view. In this case, the first compressor 10 and the second compressor 20 are arranged symmetrically with respect to a common axis (A1 and A2). As a result, a pair of rollers attached to each of the bundles 12 and 22 so as to be symmetrical with respect to the common axis can engage with the rails 333. Accordingly, the rails 333 laid at the same positions can be shared for the pullout of the first bundle 12 and the pullout of the second bundle 22.

However, depending on attachment positions of the rollers to each of the bundles 12 and 22, the rails 333 can be shared even if the axis A1 and the axis A2 are shifted from each other in the width direction.

In a case where the rails 333 are not shared, the axis A1 and the axis A2 do not necessarily need to be strictly coincident or parallel with each other. It is sufficient to lay the rails 333 to be parallel with the axis A1 of the bundle 12 to be pulled out or the axis A2 of the bundle 22 to be pulled out, at each maintenance.

[Procedure of Pulling Out Bundle of Compressor]

An example of a procedure of pulling out the first bundle 12 from the first casing 11 for inspection and maintenance of the first compressor 10 is briefly described with reference to FIG. 3. A procedure of pulling out the second bundle 22 from the second casing 21 for inspection and maintenance of the second compressor 20 is similarly performed.

In the following description, a front side in the pullout direction d1 of the first bundle 12 is referred to as "front", and a rear side in the pullout direction d1 is referred to as "rear".

In the insertion and pullout work of the first bundle 12, appropriate tools and devices are used based on the weight, the size, and the like of the first bundle 12.

As described below, in a pullout process, the first bundle 12 is pulled out from the first casing 11 to the maintenance space 50 along the axial direction of the first casing 11 toward the second bundle 22.

First, the pullout-side end part 12A of the first bundle 12 is pulled out by a predetermined length from the first casing 11 by using a tool 60 called a puller, and a pair of outside roller devices 61 are attached to the pullout-side end part 12A (step S01). At this time, inner rollers 6R provided on a rear end side of the first bundle 12 slide on unillustrated guide portions provided in an inner periphery of the first casing 11.

The pair of outside roller devices 61, the pair of inner rollers 6R, and a pair of intermediate roller devices 62 described below are arranged symmetrically with respect to the axis of the first bundle 12.

The tool 60 is inserted into a space between an outer periphery of the pullout-side end part 12A of the first bundle 12 and the inner periphery of the first casing 11. When the pullout-side end part 12A is pulled out from the first casing 11, the outside roller devices 61 are attachable to the pullout-side end part 12A.

Each of the outside roller devices 61 includes a roller 611 engaging with one of the rails 333, and a support 612 supporting the roller 611 to the first bundle 12.

The first bundle 12 is further pulled out forward from the first casing 11 by using an unillustrated push-pull driving mechanism using hydraulic pressor, air pressure or other pressure, while the first bundle 12 is guided by the outside roller devices 61 and the rails 333 in the pullout direction d1. Thereafter, the intermediate roller devices 62 are attached to predetermined positions on the outer periphery of the first bundle 12 exposed from the first casing 11 (step S02). Each of the intermediate roller devices 62 includes a roller 621 engaging with one of the rails 333, and a support 622 supporting the roller 621 to the first bundle 12. The first bundle 12 is pulled out while being maintained in a stable attitude by the outside roller devices 61 and the intermediate roller devices 62.

Depending on the weight and the size of the first bundle 12, other members supporting the first bundle 12 can be used in addition to the roller devices 61 and 62.

When the whole of the first bundle 12 is pulled out from the first casing 11 until a rear end part 12B of the first bundle 12 is taken out from the first casing 11, the pullout of the first bundle 12 is completed (step S03). When the first bundle 12 is carried away from the maintenance space 50 to release the maintenance space 50, the pullout work or the insertion work of the second bundle 22 using the maintenance space 50 can be performed. Unillustrated outside roller devices and unillustrated intermediate roller devices are also attached to the second bundle 22, and engage with the rails 333.

Figure 3:
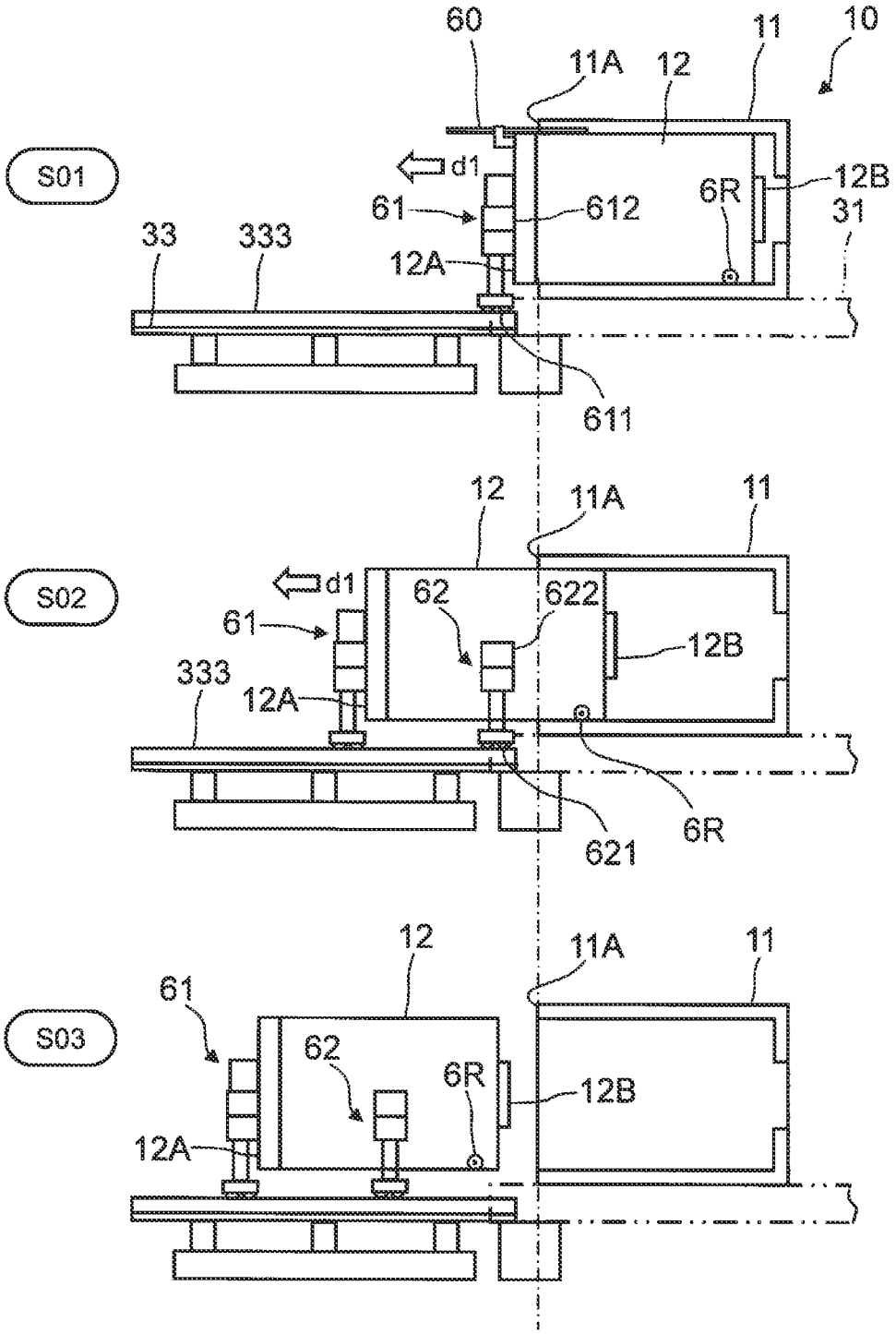
FIG. 3 is a diagram illustrating a process in which a bundle is pulled out from a casing.

A procedure when the maintained first bundle 12 is returned to the first casing 11 or a procedure when a replaced first bundle 12 or a spare first bundle 12 is inserted into the first casing 11 is substantially reversed from the procedure illustrated in FIG. 3. Therefore, description of the procedure is omitted. In the middle of an insertion process of the first bundle 12, it is necessary to detach the intermediate roller devices 62 from the first bundle 12.

[Effects by Present Embodiment]

According to the present embodiment described above, the maintenance space 50 is shared based on improvement of the arrangement of the first compressor 10 and the second compressor 20 described above. As a result, for example, as compared with the comparative example illustrated in FIG. 2, it is possible to reduce the installation space 100 of the whole of the compressor system 1 including the incidental facilities 40, and to reduce the apparatus cost. Sharing of the maintenance space 50 enables reduction in the installation space 100 and in facility investment even in an example in which the first compressor 10 and the second compressor 20 are arranged side by side such that the axis of the first compressor 10 and the axis of the second compressor 20 are parallel with each other.

When the maintenance space 50 is shared, the rails 333 guiding the bundles 12 and 22 in pullout of the bundles 12 and 22 can also be shared. It is possible to select whether the rails 333 are laid and detached before and after the maintenance and the maintenance space 50 is used as a passage during a time other than maintenance, or the rails 333 are constantly laid in the maintenance space 50. In a case where the rails 333 are constantly laid, a work in which the rails 333 are carried into the maintenance space 50 from a storage or the like and are laid on the maintenance base portion 33, and positions between the members are confirmed, and a work in which the rails 333 are detached and returned to the storage after the maintenance are unnecessary. This makes it possible to realize reduction in the time required for maintenance, which can largely contribute to improvement in productivity.

Other than the above-description, the configurations described in the above-described embodiment can be selected or appropriately modified to the other configurations.

The compressor system 1 may include three or more compressors. In other words, the compressor system 1 may include a third compressor, or may include a third compressor and a fourth compressor, in addition to the first compressor 10 and the second compressor 20. It is sufficient for the compressor system 1 to include at least a pair of compressors arranged to face each other. Among the plurality of compressors included in the compressor system 1, more compressors are preferably arranged to face each other in terms of cost reduction by saving of the installation space for the whole of the compressor system 1.

APPENDIX

The compressor system and the method of inserting and pulling out the bundle of the compressor described above can be understood as follows.

(1) The compressor system 1 includes the first compressor 10 including the first casing 11 having a cylindrical shape, and the first bundle 12 that is capable of being inserted into and pulled out from the first casing 11 in the axial direction of the first casing 11, and the second compressor 20 including the second casing 21 having a cylindrical shape, and the second bundle 22 that is capable of being inserted into and pulled out from the second casing 21 in the axial direction of the second casing 21.

The first compressor 10 and the second compressor 20 are arranged to face each other to cause the pullout directions d1 and d2 of the respective bundles 12 and 22 to be opposite to each other. The maintenance space 50 shareable for insertion and pullout operations of the first bundle 12 and insertion and pullout operations of the second bundle 22 is interposed between the first bundle 12 and the second bundle 22, and is available for the first bundle 12 or the second bundle 22 to occupy under the insertion and pullout operations.

The "bundle" corresponds to an assembly in which unillustrated components such as one or a plurality of impellors, diaphragms, bearings, and seal members are integrally assembled.

The arrangement in which the first compressor 10 and the second compressor 20 face each other means the following state.

The state is a state where a range where the first bundle 12 is projected in the axial direction of the first casing 11 toward the second bundle 22 and a range where the second bundle 22 is projected in the axial direction of the second casing 21 toward the first bundle 12 are at least partially overlapped with each other.

(2) The compressor system 1 further includes the rails 333 laid in the maintenance space 50. The rails 333 can be engaged with the rollers 611 and 621 attached to the first bundle 12 when the first bundle 12 is inserted into and pulled out from the first casing 11, and the rails 333 can be engaged with the rollers attached to the second bundle 22 when the second bundle 22 is inserted into and pulled out from the second casing 21.

(3) The compressor system 1 further includes the first base portion 31 supporting the first compressor 10, the second base portion 32 supporting the second compressor 20, and the maintenance base portion 33 supporting the rails 333.

(4) The method of inserting and pulling out the bundles 12 and 22 of the respective compressors 10 and 20 includes, in the state where the maintenance space 50 shareable for the insertion and pullout operations of the bundle 12 of the first compressor 10 having the cylindrical casing and the insertion and pullout operations of the bundle 22 of the second compressor 20 having the cylindrical casing is interposed between the bundles 12 and 22 and the first compressor 10 and the second compressor 20 are arranged to face each other to cause the pullout directions d1 and d2 of the respective bundles 12 and 22 to be opposite to each other, pulling out the bundle 12 of the first compressor 10 or the bundle 22 of the second compressor 20 from the casing 11 or 21 to the maintenance space 50 or inserting the bundle 12 of the first compressor 10 or the bundle 22 of the second compressor 20 into the casing 11 or 21, while allowing the bundle 12 or the bundle 22 to occupy the maintenance space 50.

What is claimed is:

1. A compressor system, comprising:

a first compressor including a first casing having a cylindrical shape, and a first bundle that is capable of being inserted into and pulled out from the first casing in an axial direction of the first casing; and a second compressor including a second casing having a cylindrical shape, and a second bundle that is capable of being inserted into and pulled out from the second casing in an axial direction of the second casing, wherein the first compressor and the second compressor are arranged to face each other to cause pullout directions of the respective bundles to be opposite to each other, a maintenance space shareable for insertion and pullout operations of the first bundle and insertion and pullout operations of the second bundle is interposed between the first bundle and the second bundle, and is available for the first bundle or the second bundle under the insertion and pullout operations, and the compressor system further comprises rails laid in the maintenance space, the rails being engageable with rollers attached to the first bundle when the first bundle is inserted into and pulled out from the first casing, the rails being engageable with rollers attached to the second bundle when the second bundle is inserted into and pulled out from the second casing.

2. The compressor system according to claim 1, further comprising:

a first base portion supporting the first compressor;

a second base portion supporting the second compressor; and a maintenance base portion supporting the rails.

3. The compressor system according to claim 1, wherein a length L of the maintenance space corresponds to a dimension obtained by adding a length L3 of a work region in front of the first bundle or the second bundle to a length L1 of the first bundle or a length L2 of the second bundle.

4. The compressor system according to claim 1, wherein a length L of the maintenance space corresponds to a dimension obtained by adding a length L3 of a work region in front of the first bundle or the second bundle to a larger one of a length L1 of the first bundle and a length L2 of the second bundle.

5. The compressor system according to claim 2, wherein the maintenance base portion connects the first base portion and the second base portion.

6. The compressor system according to claim 2, wherein the maintenance base portion includes a plate that is laid between an end part of the first base portion and an end part of the second base portion.

7. The compressor system according to claim 6, wherein the maintenance space is a space on the plate.

8. A method of inserting and pulling out a bundle of a compressor, the method comprising, in a state where a maintenance space shareable for insertion and pullout operations of a bundle of a first compressor having a cylindrical casing and insertion and pullout operations of a bundle of a second compressor having a cylindrical casing is interposed between the bundles and the first compressor and the second compressor are arranged to face each other to cause pullout directions of the respective bundles to be opposite to each other;

pulling out the bundle of the first compressor or the bundle of the second compressor from the corresponding casing to the maintenance space or inserting the bundle of the first compressor or the bundle of the second compressor into the corresponding casing, while allowing the bundle of the first compressor or the bundle of the second compressor to occupy the maintenance space, wherein rails are laid in the maintenance space, the rails being engageable with rollers attached to the bundle of the first compressor when the bundle of the first compressor is inserted into and pulled out from the casing of the first compressor, the rails being engageable with rollers attached to the bundle of the second compressor when the bundle of the second compressor is inserted into and pulled out from the casing of the second compressor.

9. A compressor system, comprising:

a first compressor including a first casing having a cylindrical shape, and a first bundle that is capable of being inserted into and pulled out from the first casing in an axial direction of the first casing; and a second compressor including a second casing having a cylindrical shape, and a second bundle that is capable of being inserted into and pulled out from the second casing in an axial direction of the second casing, wherein the first compressor and the second compressor are arranged to face each other to cause pullout directions of the respective bundles to be opposite to each other, a maintenance space shareable for insertion and pullout operations of the first bundle and insertion and pullout operations of the second bundle is interposed between the first bundle and the second bundle, and is available for the first bundle or the second bundle under the insertion and pullout operations, and a length L of the maintenance space corresponds to a dimension obtained by adding a length L3 of a work region in front of the first bundle or the second bundle to a length L1 of the first bundle or a length L2 of the second bundle.

* * * * *